US010876083B2

(12) United States Patent
Diamantis et al.

(10) Patent No.: US 10,876,083 B2
(45) **Date of Patent: *Dec. 29, 2020**

(54) BREWING VESSEL CLEANING COMPOSITION AND RELATED METHODS OF USE

(71) Applicant: Zee Company, Inc., Chattanooga, TN (US)

(72) Inventors: James Diamantis, Fleming Island, FL (US); Keith Seyfried, Ooltewah, TN (US); Jonathan R. Bullard, Chattanooga, TN (US); James A. Faller, Chattanooga, TN (US); Robert C. Bullard, Signal Mountain, TN (US)

(73) Assignee: ZEE COMPANY, INC., Chattanooga, TN (US)

( * ) Notice: Subject to any disclaimer, the term of this patent is extended or adjusted under 35 U.S.C. 154(b) by 58 days.

This patent is subject to a terminal disclaimer.

(21) Appl. No.: 16/240,313

(22) Filed: Jan. 4, 2019

(65) Prior Publication Data

US 2019/0136160 A1 May 9, 2019

Related U.S. Application Data

(63) Continuation of application No. 15/202,020, filed on Jul. 5, 2016, now Pat. No. 10,208,274.

(60) Provisional application No. 62/187,959, filed on Jul. 2, 2015.

(51) Int. Cl.

| | |
|---|---|
| ***C11D 1/92*** | (2006.01) |
| ***C11D 3/39*** | (2006.01) |
| ***C11D 7/50*** | (2006.01) |
| ***B08B 3/04*** | (2006.01) |
| ***B08B 3/08*** | (2006.01) |
| ***C11D 11/00*** | (2006.01) |
| ***C11D 3/36*** | (2006.01) |
| ***C11D 1/75*** | (2006.01) |
| ***C11D 3/20*** | (2006.01) |
| ***B08B 9/08*** | (2006.01) |
| ***C11D 1/94*** | (2006.01) |
| ***C11D 3/04*** | (2006.01) |
| ***B08B 3/10*** | (2006.01) |

(52) U.S. Cl.

CPC ..... *C11D 11/0041* (2013.01); *B08B 3/08* (2013.01); *B08B 3/102* (2013.01); *B08B 9/08* (2013.01); *B08B 9/0804* (2013.01); *C11D 1/75* (2013.01); *C11D 1/92* (2013.01); *C11D 1/94* (2013.01); *C11D 3/042* (2013.01); *C11D 3/2068* (2013.01); *C11D 3/2082* (2013.01); *C11D 3/2086* (2013.01); *C11D 3/361* (2013.01); *C11D 3/3942* (2013.01); *C11D 3/3947* (2013.01)

(58) Field of Classification Search

CPC ..... C11D 1/665; C11D 1/92; C11D 3/042; C11D 3/39; C11D 7/50; C11D 11/0041; B08B 3/04; B08B 3/08

See application file for complete search history.

(56) References Cited

U.S. PATENT DOCUMENTS

| | | | |
|---|---|---|---|
| 5,645,648 | A | 7/1997 | Laut et al. |
| 6,168,808 | B1 | 1/2001 | Hamon Godin et al. |
| 6,277,801 | B1 | 8/2001 | Dahanayake |
| 6,444,636 | B1 | 9/2002 | Toussaint et al. |
| 7,887,641 | B2 | 2/2011 | Man et al. |
| 7,943,565 | B2 | 5/2011 | Kany et al. |
| 8,211,239 | B1 | 7/2012 | Johnson |
| 8,753,453 | B2 | 6/2014 | Martinez-Crowley et al. |
| 10,208,274 | B1 * | 2/2019 | Diamantis ..... C11D 11/0041 |
| 2002/0168422 | A1 | 11/2002 | Hei et al. |
| 2003/0064903 | A1 | 4/2003 | Coughlin et al. |
| 2006/0042665 | A1 | 3/2006 | Fernholz et al. |
| 2006/0046945 | A1 | 3/2006 | Herdt et al. |
| 2008/0095677 | A1 | 4/2008 | McSherry et al. |
| 2008/0105282 | A1 | 5/2008 | Fernholz |
| 2008/0121250 | A1 | 5/2008 | Fernholz et al. |

(Continued)

FOREIGN PATENT DOCUMENTS

| | | | |
|---|---|---|---|
| CA | 2 620 240 | A1 | 3/2007 |
| CA | 2 831 536 | A1 | 11/2012 |

(Continued)

OTHER PUBLICATIONS

Material Safety Data Sheet, Birko Ultra Niter, Sep. 24, 2008, 4 pages.

*Primary Examiner* — Brian P Mruk

(74) *Attorney, Agent, or Firm* — Patterson Thuente Pedersen, P.A.

(57) ABSTRACT

An acidic cleaning composition and related methods of use for rapidly cleaning and sanitizing hard contact surfaces in the food and beverage industry. The acidic cleaning composition includes a concentrated acidic solution, a strong oxidizer, a surfactant, a suitable solvent and/or sufficient quantities of water. The acidic cleaning composition rapidly removes soils from food and beverage contact surfaces such as, for example, brewing vats and kegs, without requiring $CO_2$ be removed from the brewery vessel. The acidic cleaning composition can be in a concentrated form for dilution with additional dilution water at ambient or faucet temperature as opposed to requiring the use of "hot" water. The acidic cleaning composition is free-rinsing leaving essentially no residue on the contact surface. The surfactant provides low-foam properties so as to avoid cavitation and damage within a pump assembly.

27 Claims, No Drawings

(56) References Cited

U.S. PATENT DOCUMENTS

| | | | | |
|---|---|---|---|---|
| 2009/0081311 | A1 | 3/2009 | Man et al. | |
| 2009/0139546 | A1 | 6/2009 | Laffitte et al. | |
| 2010/0229899 | A1 | 9/2010 | Anderson | |
| 2010/0236581 | A1 | 9/2010 | Fernholz et al. | |
| 2013/0000681 | A1 | 1/2013 | Johnson et al. | |
| 2013/0018097 | A1 | 1/2013 | Bolduc et al. | |
| 2014/0261550 | A1 | 9/2014 | Erickson et al. | |
| 2014/0338703 | A1* | 11/2014 | Craft ..... | C11D 3/3947 134/22.1 |
| 2017/0028449 | A1 | 2/2017 | Fernholz et al. | |
| 2019/0136160 | A1 | 5/2019 | Diamantis et al. | |

FOREIGN PATENT DOCUMENTS

| | | | |
|---|---|---|---|
| CA | 2 856 820 | A1 | 11/2012 |
| CA | 2 857 277 | A1 | 6/2013 |
| WO | WO 2012/160497 | A3 | 11/2012 |
| WO | WO 2012/160498 | A3 | 11/2012 |
| WO | WO 2013/088266 | A1 | 6/2013 |

* cited by examiner

BREWING VESSEL CLEANING COMPOSITION AND RELATED METHODS OF USE

CROSS-REFERENCE TO RELATED APPLICATIONS

This application is a continuation of application Ser. No. 15/202,020 which has issued as U.S. Pat. No. 10,208,274, filed Jul. 5, 2016, which claims the benefit of U.S. Provisional Application No. 62/187,959, filed Jul. 2, 2015, each of which is hereby fully incorporated herein by reference.

TECHNICAL FIELD

The present invention is directed to an acidic cleaning composition for use in cleaning hard surfaces, particularly food and beverage contact surfaces. More specifically, the present invention is directed to a concentrated acidic cleaning composition that performs in spaces having elevated CO2 levels such as within vats and kegs found in the brewing industry while being both low foaming and free-rinsing to promote cleaning and sanitization performance.

BACKGROUND

In the brewing industry, alkaline cleaning solutions have traditionally been used with hot water to clean the interior of brewing vats and kegs. Traditionally, these alkaline solutions have been used at pH levels of between 12-14. In addition, some of these alkaline solutions contain additional additives to assist in the cleaning and sanitation process including, for example, various surfactants and sanitization chemicals, i.e. "bleach".

One downside of using the traditional alkaline cleaning solutions is that their effectiveness can be reduced in the elevated carbon dioxide ($CO_2$) environments found within brewing vats and kegs. In order to get the best results with the alkaline cleaning solutions, the $CO_2$ must be removed or otherwise vented prior to cleaning. This adds additional time and labor to the cleaning process. In addition, these alkaline cleaning solutions generally require the use of hot water for effective performance. The alkaline cleaning solutions also may leave residues and are therefore not free-rinsing.

A number of acidic cleaning solutions have been developed for brewing vats and kegs, including, for example, the Ultra Niter™ cleaning product available from Birko Corp. of Henderson, Colo. as well as those compositions identified in the U.S. Pat. No. 5,645,648 to Laut et al., U.S. Pat. No. 6,168,808 to Hamon Godin et al., U.S. Pat. No. 7,943,565 to Kany et al., U.S. Pat. No. 8,211,239 to Johnson and US Patent Publication Numbers 2003/0064903 to Coughlin et al., 2009/0139546 to Laffitte et al., and 2013/0000681 to Johnson et al., the disclosures of which are all herein incorporated by reference to the extent not inconsistent with the present disclosure. Even with the availability of these acidic cleaning solutions, it would be advantageous to further improve upon the performance of these acidic cleaning solutions and the processes for cleaning hard surfaces, particularly vats and kegs containing $CO_2$.

SUMMARY

The present invention is directed to an acidic cleaning composition and related methods of use for rapidly cleaning and sanitizing hard surfaces, particularly food and beverage contact surfaces such as, for example, brewing vats and kegs in the beer brewing industry. The acidic cleaning composition generally comprises a concentrated acidic solution, a strong oxidizer, a surfactant, a suitable solvent and sufficient quantities of water. The acidic cleaning composition rapidly removes soils from food and beverage contact surfaces such as, for example, brewing vats and kegs, without requiring $CO_2$ be removed from the brewery vessel. The acidic cleaning composition of the present invention can also be used with water at ambient temperature as opposed to requiring the use of "hot" water. In some aspects, the composition is rinsed from the hard surface, such as the beverage contact surface, a single time without requiring an additional rinse, such that the acidic cleaning composition is free-rinsing in that it does not leave a visual residue or require any additional rinsing step. Following cleaning and sanitization with the acidic cleaning composition, the food and beverage contact surfaces including, for example, the interior surfaces of the brewery vessel are left scale-free and bright. The surfactant provides the acidic cleaning composition with low-foam properties so as to allow for recirculation using conventional Clean-In-Place (CIP) systems without leading to cavitation and/or potential damage within a pump assembly. The acidic cleaning composition can reduce the time necessary for cleaning and sanitation by eliminating the requirement of $CO_2$ venting as well as eliminating additional rinse steps to remove scale and brighten food and beverage contact surfaces including, for example, interior surfaces of the brewing vessel.

In one aspect of the present invention, the concentrated acidic solution can comprise a combination of mineral (inorganic) and organic acids in an amount from about 5% to about 95% by volume, more preferably about 8% to about 75% by volume, more preferably about 8% to about 50% by volume, more preferably about 20% to about 30% by volume, and most preferably about 22% to about 28% by volume of the acidic cleaning composition. The mineral acid can comprise representative inorganic acids in an amount from about 5% to about 72% by volume of the acidic cleaning composition including, for example, phosphoric acid, sulfuric acid, hydrochloric acid, nitric acid, boric acid, hydrofluoric acid, hydrobromic acid, chromic acid, and perchloric acid. The organic acids can comprise representative organic acids in an amount from about 0.5% to about 45% by volume of the acidic cleaning composition and more preferably from about 0.5% to about 3% by volume including, for example, carboxylic acids, sulfonic acids and phosphonic acids. In embodiments in which the organic acids comprise carboxylic acids, representative carboxylic acid species can comprise lactic and citric acids. In a representative embodiment of the present invention, the combination of mineral and organic acids can further comprise phosphonic acid and/or a chelant component in an amount from about 0.5% to about 3% by volume of acidic cleaning composition, and more preferably in an amount from about 0.5% to about 2% by volume of the acidic cleaning composition. The phosphoric acid and/or chelant compound can include etidronic (HEDP) acid (1-Hydroxyethylidene-1,1-diphosphonic acid), ATMPT (Aminotris(methylenephosphonic acid), EDTMP (Ethylenediaminetetra(methylenephosphonic acid), TDTMP (Tetramethylenediaminetetra (methylenephosphonic acid), HDTMP (Hexamethylenediaminetetra(methylenephosphonic acid), DTPMP (Diethylenetriaminepenta(methylenephosphonic acid), 2-phosphonobutane 1,2,4-tricarboxylic acid, Nitrilotrimethylenetris(diphosphonic acid) or mixtures thereof. In addition to lower pH, representative mineral and organic acids as used in the concentrated acidic solution can include other suitable properties including chelating properties, antioxidant properties, bleaching properties, stain suppression and other properties suitable to cleaning and sanitization of food and beverage contact surfaces.

In addition to the combination of mineral and organic acids, the acidic cleaning composition of the present invention can further comprise a surfactant in an amount from about 1 to about 30%, more preferably about 2% to about 10%, more preferably from about 2 to about 7% and most preferably about 2% to about 5% by volume of the acidic cleaning composition. Preferably, the surfactant comprises a low-foaming surfactant such as, for example, a low-foaming sultaine surfactant and/or a amine oxide surfactant. Representative low-foaming sultaine surfactants can comprise alkyl ether hydroxypropyl sultaine and/or cocamidopropyl hydroxysultaine in amounts from about 0.5% to about 15% by volume of the acidic cleaning composition, and more preferably in an amount from about 1 to about 5% by volume. In addition to sultaine surfactants, the acidic cleaning composition can additional comprise amine oxide surfactants including, for example, decyl dimethylamine oxide, lauryl dimethylamine oxide, dihydroxyethyl cocamine oxide, myristyl dimethylamine oxide, cetyl dimethylamine oxide, oleyl dimethylamine oxide and octyl dimethylamine oxide in amounts from about 0.5% to about 15% by volume of the acidic cleaning composition, and more preferably in an amount from about 1 to about 5% by volume.

The acidic cleaning composition of the present invention can further comprise a strong oxidizing agent in an amount from about 1% to about 25%, more preferably about 2% to about 15%, and most preferably about 3% to about 10% by volume of the acidic cleaning composition. The strong oxidizing agent can comprise, for example, hydrogen peroxide.

The acidic cleaning composition of the present invention can further comprise a suitable solvent that is chemically compatible with the other components. The solvent can be present in an amount from about 0.5% to about 15%, more preferably about 1% to about 8%, and most preferably about 2% to about 7% by volume of the acidic cleaning composition. The solvent can comprise, for example, glycol either solvent.

In addition, the acidic cleaning composition can further comprise water in quantities sufficient to achieve the desired concentrations of mineral and organics acids, surfactant, oxidizing agent and/or solvent components, such that the ratio of such components remains the same upon dilution by the addition of water. One of ordinary skill in the art will thus appreciate that the foregoing disclosed amounts of components also disclose respective ratios of such components.

In one aspect, the present invention is directed to an acidic cleaning composition for use with food and beverage contact surfaces, such as, for example, brewing surfaces including interior surfaces of brewing vats and kegs. The acidic cleaning composition generally comprises a concentrated acidic solution including a combination of mineral and organic acids, a surfactant, a strong oxidizing agent, a suitable solvent and sufficient quantities of water. In one presently preferred embodiment, the acidic cleaning composition can comprise a concentrated acidic solution of phosphoric acid, hydroxyacetic acid and etidronic acid, hydrogen peroxide, a low-foaming surfactant, glycol ether solvent and water. Preferably, the low-foaming surfactant comprises a very low-foaming sultaine surfactant.

In another aspect, the present invention is directed to a method for cleaning a food and beverage contact surface such as, for example, a brewery vessel with an acidic cleaning composition. The method can comprise a step of diluting the acidic cleaning composition with additional dilution water at ambient or faucet temperature to form an acidic cleaning solution. The method can comprise a step of introducing the acidic cleaning solution to a food and beverage contact surface such as, for example, an interior or the brewery vessel, wherein the acidic cleaning solution comprises phosphoric acid, hydroxyacetic acid, etidronic acid, hydrogen peroxide, a low-foaming sultaine surfactant, glycol either solvent and/or water. The step of introducing can further comprise a step of recirculating the acidic cleaning solution using a CIP system having a pump assembly, wherein the surfactant can comprise a very low foaming sultaine surfactant so as to avoid cavitation within and potential damage to the pump assembly. The method can further include introducing the acidic cleaning solution into a food or beverage environment, for example, within a brewery vessel such as a vat or keg, wherein an internal atmosphere of the environment has elevated levels of $CO_2$. The method can further comprise removing residue and brightening food and beverage contact surfaces simply by rinsing the food and beverage contact surfaces with water. The method can further comprise introducing the acidic cleaning solution into the food or beverage environment without having to vent $CO_2$ levels within the internal atmosphere.

The above summary of the various representative embodiments of the invention is not intended to describe each illustrated embodiment or every implementation of the invention. Rather, the embodiments are chosen and described so that others skilled in the art can appreciate and understand the principles and practices of the invention.

DETAILED DESCRIPTION OF THE INVENTION

An acidic cleaning composition according to representative embodiments of the present invention can provide for rapid cleaning and sanitizing of food and beverage contact surfaces. The acidic cleaning composition especially finds beneficial use in the brewing industry such as in cleaning and sanitizing brewing vats and kegs. In using the acidic cleaning composition of the present invention, conventional steps of removing $CO_2$ prior to cleaning, as is required to achieve best results with alkaline cleaners, can be avoided. Furthermore, the acidic cleaning composition can be used at ambient or "faucet" temperature as opposed to requiring heated or "hot" water to achieve desired cleaning and sanitization results. Following cleaning and sanitization, the acidic cleaning composition of the present invention is free rinsing, i.e., no residues are left on the food and beverage contact surface following a rinse with water. Following rinsing of the acidic cleaning composition from the food and beverage contact surface, the surfaces are left scale-free and bright in appearance with no visual residue. In addition, the acidic cleaning composition can comprise anti or low-foam properties so as to allow for recirculation using conventional Clean-In-Place (CIP) systems without leading to cavitation and/or potential damage within a pump assembly. Through the elimination of time necessary for $CO_2$ venting and additional rinse steps, the acidic cleaning composition reduces overall downtime associated with cleaning and sanitizing food and beverage contact surfaces, thereby increasing productivity and use of these services.

A representative acidic cleaning composition of the present invention generally comprises a concentrated acidic solution, a strong oxidizer, a surfactant, a suitable solvent and sufficient quantities of water. Generally, the acidic cleaning composition can be provided as a concentrate that is intended for diluting prior to use in cleaning food and beverage contact surfaces. For instance, the acidic cleaning composition in concentrate form can be mixed and diluted with additional dilution water prior to use at an amount of 1 to 32 ounces of acidic cleaning composition per gallon of additional dilution water to form an acidic cleaning solution. The additional dilution water used for dilution can be at ambient/faucet temperature or the additional dilution water can be heated to an elevated temperature, though "hot" water is not required for successful use of the resulting acidic cleaning solution.

The concentrated acidic solution can comprise a combination of mineral (inorganic) and organic acids in an amount from about 5% to about 95% by volume, more preferably from about more preferably about 8% to about 75% by volume, more preferably about 8% to about 50%, more preferably about 20% to about 30% by volume, and most preferably about 22% to about 28% by volume of the acidic cleaning composition. The mineral acid can comprise representative inorganic acids in an amount from about 5% to about 72% by volume of the acidic cleaning composition including, for example, phosphoric acid, sulfuric acid, hydrochloric acid, nitric acid, boric acid, hydrofluoric acid, hydrobromic acid, chromic acid, and perchloric acid. The organic acids can comprise representative organic acids in an amount from about 0.5% to about 45% by volume of the acidic cleaning composition, and more preferably about 0.5% to about 3% by volume including, for example, carboxylic acids, sulfonic acids and phosphonic acids. In some embodiments in which the organic acids comprise carboxylic acids, representative carboxylic acid species can comprise lactic and citric acids.

In a representative embodiment of the present invention, the combination of mineral and organic acids can further comprise a phosphoric acid, glycolic (hydroxyacetic) acid, etidronic (HEDP) acid and/or suitable chelating components in an amount from about 0.5% to about 3% by volume of the acidic cleaning composition, and more preferably in an amount from about 0.5% to about 2% by volume of the acidic cleaning composition. The phosphoric acid and/or chelant compound can include etidronic (HEDP) acid (1-Hydroxyethylidene-1,1-diphosphonic acid), ATMPT (Aminotris(methylenephosphonic acid), EDTMP (Ethylenediaminetetra(methylenephosphonic acid), TDTMP (Tetramethylenediaminetetra(methylenephosphonic acid), HDTMP (Hexamethylenediaminetetra(methylenephosphonic acid), DTPMP (Diethylenetriaminepenta(methylenephosphonic acid), 2-phosphonobutane 1,2,4-tricarboxylic acid, Nitrilotrimethylenetris(diphosphonic acid) or mixtures thereof. In addition to lower pH, representative mineral and organic acids as used in the concentrated acidic solution can include other suitable properties including chelating properties, antioxidant properties, bleaching properties, stain suppression and other properties suitable to cleaning and sanitization of food and beverage contact surfaces.

The surfactant in the acidic cleaning composition of the present invention can be present in an amount from about 1% to about 30%, more preferably from about 2% to about 10%, more preferably about 2% to about 7% and most preferably about 2% to about 5% by volume of the acidic cleaning composition. Preferably, the surfactant comprises one or more surfactants such as, for example a low-foaming surfactant such as, for example, a low-foaming sultaine surfactant and/or a low foaming amine oxide surfactant. The low-foaming sultaine surfactant preferably comprises alkyl ether hydroxypropyl sultaine. Alternatively, the low-foaming sultaine surfactant can comprise cocamidopropyl hydroxysultaine. The amine oxide surfactant preferably comprises octyl dimethylamine oxide, though other amine oxide surfactants including decyl dimethylamine oxide, lauryl dimethylamine oxide, dihydroxyethyl cocamine oxide, myristyl dimethylamine oxide, cetyl dimethylamine oxide and oleyl dimethylamine oxide can be utilized as well. The one or more surfactants can be present in equivalent amounts. Alternatively, the low-foaming sultaine surfactant can be present in an amount from about 0.5% to about 15% by volume of the acidic cleaning composition and more preferably in an amount from about 1-5% by volume. The amine oxide surfactant can be present in an amount from about 0.5% to about 15% by volume of the acidic cleaning composition and more preferably in an amount from about 1 to about 5% by volume. Through the use of the low-foaming surfactant, recirculation of the acidic cleaning composition can be accomplished using traditional CIP systems without risk of cavitation and subsequent pump damage.

The acidic cleaning composition of the present invention can further comprise a strong oxidizing agent. The strong oxidizing agent can comprise, for example, hydrogen peroxide. The strong oxidizing agent can be provided in an amount from about 1% to about 25%, more preferably about 2% to about 15%, most preferably about 3% to about 10% by volume of the acidic cleaning composition. In some aspects, the hydrogen peroxide is provided in the acidic cleaning composition up to 35% w/v/in water to provide the foregoing disclosed amounts.

The acidic cleaning composition can further comprise a suitable solvent that is chemically compatible with the other components. The solvent can be present in an amount from about 0.5% to about 15%, more preferably about 1% to about 8%, most preferably about 2% to about 7% by volume of the acidic cleaning composition. The solvent can comprise, for example, glycol either solvent.

In addition, the acidic cleaning composition can further comprise water in quantities sufficient to achieve the desired concentrations of mineral and organics acids, surfactant, oxidizing agent and solvent.

A representative embodiment of the acidic cleaning composition of the present invention can be formulated as follows:

| Component | Volume % of Acidic Cleaning Composition |
|---|---|
| Concentrated Acidic Solution | 8-75% |
| Phosphoric Acid | 5-72% |
| Hydroxyacetic Acid | 3-45% |
| Etidronic Acid | 0.5-30% |
| Surfactant | 1-30% |
| Sultaine Surfactant | 0.5-15% |
| Amine Oxide Surfactant | 0.5-15% |
| Hydrogen Peroxide | 1-10% |
| Glycol Ether Solvent | 1-8% |
| Water | Quantity Sufficient |

In the preceding formulation, the phosphoric acid can also include a combination of other mineral acids while the hydroxyacetic acid can also include a combination of other organic acids.

One presently preferred embodiment of an acidic cleaning composition according to the present invention can comprise the following composition:

| Component | Volume % of Acidic Cleaning Composition |
|---|---|
| Concentrated Acidic Solution | 20-35% |
| Phosphoric Acid | 19-29% |
| Hydroxyacetic Acid | 0.5-3% |
| Etidronic Acid | 0.5-2% |
| Surfactant | 2-10% |
| Sultaine Surfactant | 1-5% |
| Amine Oxide Surfactant | 1-5% |
| Hydrogen Peroxide | 1-10% |
| Glycol Ether Solvent | 1-8% |
| Water | Quantity Sufficient |

Generally, the acidic cleaning composition of the present invention can be utilized for cleaning and sanitizing food/beverage contact surfaces by first diluting the acidic cleaning composition with appropriate amounts of dilution water at ambient or faucet temperature. Depending upon the composition, the acidic cleaning composition can be diluted at a rate of about 1 to 32 fluid ounces of acidic cleaning composition per gallon of dilution water to form an acidic cleaning solution. The acidic cleaning solution can then be introduced to the food and beverage contact surface, for instance, by introducing the acidic cleaning solution into a brewery vessel or keg. The step of introducing the acidic cleaning solution can further comprise a step of recirculating the acidic cleaning solution using a CIP system having a pump assembly, wherein the surfactant prevents foaming and cavitation so as to avoid potential damage to a pump assembly. The method of introducing can further include introducing the acidic cleaning solution into a food and beverage environment, for example, with a brewery vessel such as a vat or keg, wherein an internal atmosphere of the environment has elevated levels of $CO_2$, such that it is not necessary to evacuate any or all of the $CO_2$ from the internal atmosphere. The method can further comprise rinsing the food and beverage contact surface with rinse water a single time, whereby any residual residues are removed leaving a clean internal atmosphere.

In some aspects, the food and beverage contact surface is pre-rinsed with pre-rinse water to remove gross soil. The acidic cleaning solution is then applied and allowed to remain in contact with the food and beverage contact surface to be cleaned for a sufficient amount of time for the detergent to act on any remaining soil. The acidic cleaning solution on the food and beverage contact surface is then rinsed with rinse water to flush away the remaining soil/acidic cleaning solution. The acidic cleaning solution is free-rinsing such that no residues are expected to remain following the rinse.

The above summary of the various representative embodiments of the invention is not intended to describe each illustrated embodiment or every implementation of the invention. Rather, the embodiments are chosen and described so that others skilled in the art can appreciate and understand the principles and practices of the invention.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents.

The invention claimed is:

1. An acidic cleaning composition for cleaning food and beverage contact surfaces, comprising:

an acidic solution comprising about 8% to about 75% by volume of the acidic cleaning composition, the acidic solution comprising a combination of at least one inorganic acid in an amount of about 5% to about 72% by volume of the acidic solution, at least one organic acid in an amount of about 0.5% to about 45% by volume of the acidic solution, and at least one chelant component in an amount of about 0.5% to about 30% by volume of the acidic cleaning composition, the at least one chelant component chosen from etidronic (HEDP) acid (1-Hydroxyethylidene-1,1-diphosphonic acid), ATMPT (Aminotris(methylenephosphonic acid), EDTMP (Ethylenediaminetetra(methylenephosphonic acid), TDTMP (Tetramethylenediaminetetra(methylenephosphonic acid), HDTMP (Hexamethylenediaminetetra(methylenephosphonic acid), DTPMP (Diethylenetriaminepenta(methylenephosphonic acid), 2-phosphonobutane 1,2,4-tricarboxylic acid, Nitrilotrimethylenetris(diphosphonic acid), and mixtures thereof;

at least one surfactant in an amount of about 1% to about 30% by volume of the acidic cleaning composition;

an oxidizing agent comprising hydrogen peroxide present in an amount from about 1% to about 25% by volume of the acidic cleaning composition;

optionally a solvent present in an amount from about 1% to about 8% by volume of the acidic cleaning composition; and water in an amount sufficient to achieve the desired concentration of the acidic solution, at least one surfactant, oxidizing agent, and optional solvent.

2. The acidic cleaning composition of claim 1, wherein the acid solution comprises phosphoric acid in an amount of about 5% to about 72% by volume of the acidic solution, hydroxyacetic acid in an amount of about 0.5% to about 45% by volume of the acidic solution, and etidronic (HEDP) acid in an amount of about 0.5% to about 3% by volume of the acidic solution.

3. The acidic cleaning composition of claim 1, wherein the acid solution comprises phosphoric acid in an amount of about 5% to about 72% by volume of the acidic solution.

4. The acidic cleaning composition of claim 1, wherein the acid solution comprises hydroxyacetic acid in an amount of about 0.5% to about 45% by volume of the acidic solution.

5. The acidic cleaning composition of claim 1, wherein the acid solution comprises etidronic (HEDP) acid in an amount of about 0.5% to about 3% by volume of the acidic solution.

6. The acidic cleaning composition of claim 1, wherein the acidic solution further comprises sulfuric acid.

7. The acidic cleaning composition of claim 1, wherein the chelant component is in an amount from about 0.5% to about 3% by volume of the acidic cleaning composition.

8. The acidic cleaning composition of claim 1, wherein the at least one surfactant comprises a sultaine surfactant in an amount from about 0.5% to about 5% of by volume of the acidic cleaning composition.

9. The acidic cleaning composition of claim 8, wherein the sultaine surfactant comprises alkyl ether hydroxypropyl sultaine or cocamidopropyl hydroxysultaine.

10. The acidic cleaning composition of claim 1, wherein the at least one surfactant comprises an amine oxide in an amount from about 0.5% to about 5% of by volume of the acidic cleaning composition.

11. The acidic cleaning composition of claim 10, wherein the amine oxide surfactant comprises octyl dimethylamine oxide, decyl dimethylamine oxide, lauryl dimethylamine oxide, dihydroxyethyl cocamine oxide, myristyl dimethylamine oxide, cetyl dimethylamine oxide or oleyl dimethylamine oxide.

12. The acidic cleaning composition of claim 1, wherein the oxidizing agent comprises hydrogen peroxide in an amount from about 2% to about 15% by volume of the acidic cleaning composition.

13. The acidic cleaning composition of claim 1, wherein the solvent is glycol ether.

14. An acidic cleaning solution comprising the acidic cleaning composition of claim 1 and dilution water, wherein the acidic cleaning composition is mixed with the dilution water at a ratio of 1 to 32 fluid ounces of acidic cleaning composition per US gallon of dilution water.

15. A method for cleaning a food and beverage contact surface, comprising:

introducing the acidic cleaning solution of claim 14 to a food and beverage contact surface.

16. The method of claim 15, wherein the food and beverage contact surface comprises an interior surface of a brewery vessel.

17. The method of claim 16, wherein the brewery vessel contains elevated levels of $CO_2$.

18. The method of claim 15, wherein the dilution water is at ambient temperature.

19. The method of claim 15, further comprising rinsing the food and beverage contact surface with rinse water to remove residue from the food and beverage contact surfaces.

20. A method for cleaning a food and beverage contact surface, the method comprising:

introducing an acid cleaning solution to a food and beverage contact surface, the acid cleaning solution including an acidic cleaning composition comprising: an acidic solution comprising about 8% to about 75% by volume of the acidic cleaning composition, the acidic solution comprising a combination of at least three mineral and organic acids including phosphoric acid in an amount of about 5% to about 72% by volume of the acidic solution, hydroxyacetic acid in an amount of about 0.5% to about 45% by volume of the acidic solution, etidronic (HEDP) acid in an amount of about 0.5% to about 30% by volume of the acidic solution, and optionally sulfuric acid;

a surfactant comprising a sultaine surfactant and an amine oxide surfactant in an amount of about 1% to about 30% by volume of the acidic cleaning composition, the sultaine surfactant comprising about 0.5% to about 15% by volume of the acidic cleaning composition, and the amine oxide surfactant comprising about 0.5% to about 15% by volume of the acidic cleaning composition;

an oxidizing agent comprising hydrogen peroxide present in an amount from about 1% to about 25% by volume of the acidic cleaning composition;

optionally a solvent present in an amount from about 1% to about 8% by volume of the acidic cleaning composition; and water in an amount sufficient to achieve the desired concentration of the acidic solution, at least one surfactant, oxidizing agent, and optional solvent; and rinsing the food and beverage contact surface with rinse water to remove residue from the food and beverage contact surfaces.

21. An acidic cleaning composition for cleaning food and beverage contact surfaces, comprising:

an acidic solution comprising about 30% to about 75% by volume of the acidic cleaning composition, the acidic solution comprising at least one inorganic acid in an amount of about 5% to about 72% by volume of the acidic solution, the at least one inorganic acid chosen from phosphoric acid, sulfuric acid, or a combination thereof, at least one organic acid in an amount of about 0.5% to about 45% by volume of the acidic solution, and at least one chelant component in an amount of about 0.5% to about 30% by volume of the acidic cleaning composition, the at least one chelant component chosen from etidronic (HEDP) acid (1-Hydroxyethylidene-1,1-diphosphonic acid), ATMPT (Aminotris(methylenephosphonic acid), EDTMP (Ethylenediaminetetra(methylenephosphonic acid), TDTMP (Tetramethylenediaminetetra(methylenephosphonic acid), HDTMP (Hexamethylenediaminetetra(methylenephosphonic acid), DTPMP (Diethylenetriaminepenta(methylenephosphonic acid), 2-phosphonobutane 1,2,4-tricarboxylic acid, Nitrilotrimethylenetris(diphosphonic acid), and mixtures thereof;

at least one surfactant in an amount of about 1% to about 30% by volume of the acidic cleaning composition;

an oxidizing agent comprising hydrogen peroxide present in an amount from about 1% to about 25% by volume of the acidic cleaning composition;

optionally a solvent present in an amount from about 1% to about 8% by volume of the acidic cleaning composition; and water in an amount sufficient to achieve the desired concentration of the acidic solution, at least one surfactant, oxidizing agent, and optional solvent.

22. The acidic cleaning composition of claim 21, wherein the at least one chelant component acid solution comprises etidronic (HEDP) acid in an amount of about 0.5% to about 3% by volume of the acidic solution.

23. The acidic cleaning composition of claim 22, wherein the at least one inorganic acid is phosphoric acid and sulfuric acid in an amount of about 20% to about 35% by volume of the acidic solution.

24. The acidic cleaning composition of claim 23, wherein the at least one organic acid in an amount of about 0.5% to about 3% by volume of the acidic solution.

25. An acidic cleaning composition for cleaning food and beverage contact surfaces, comprising:

an acidic solution comprising about 30% to about 75% by volume of the acidic cleaning composition, the acidic solution comprising at least one inorganic acid in an amount of about 5% to about 72% by volume of the acidic solution, at least one organic acid in an amount of about 0.5% to about 45% by volume of the acidic solution, the at least one organic acid being a carboxylic acid, sulfonic acid or phosphonic acid, and at least one chelant component in an amount of about 0.5% to about 30% by volume of the acidic cleaning composition, the at least one chelant component chosen from etidronic (HEDP) acid (1-Hydroxyethylidene-1,1-diphosphonic acid), ATMPT (Aminotris(methylenephosphonic acid), ED TMP (Ethylene diaminetetra(methylenephosphonic acid), TDTMP (Tetramethylenediaminetetra(methylenephosphonic acid), HD TMP (Hexamethylenediaminetetra(methylenephosphonic acid), DTPMP (Diethylenetriaminepenta(methylenephosphonic acid), 2-phosphonobutane 1,2,4-tricarboxylic acid, Nitrilotrimethylenetris(diphosphonic acid), and mixtures thereof;

at least one surfactant in an amount of about 1% to about 30% by volume of the acidic cleaning composition;

an oxidizing agent comprising hydrogen peroxide present in an amount from about 1% to about 25% by volume of the acidic cleaning composition;

optionally a solvent present in an amount from about 1% to about 8% by volume of the acidic cleaning composition; and water in an amount sufficient to achieve the desired concentration of the acidic solution, at least one surfactant, oxidizing agent, and optional solvent.

26. The acidic cleaning composition of claim 25, wherein the at least one organic acid in an amount of about 0.5% to about 3% by volume of the acidic solution.

27. The acidic cleaning composition of claim 26, wherein the at least one chelant component acid solution comprises etidronic (HEDP) acid in an amount of about 0.5% to about 3% by volume of the acidic solution.

* * * * *